US005584129A

United States Patent [19]

Williamson

[11] Patent Number: 5,584,129

[45] Date of Patent: Dec. 17, 1996

[54] QUICK CONNECTOR FOR A DRYER DUCT AND EXTERNAL VENT

[76] Inventor: Doyt J. Williamson, P.O. Box 84, Chapmanville, W. Va. 25508

[21] Appl. No.: 387,202

[22] Filed: Feb. 13, 1995

[51] Int. Cl.[6] ..... F26B 25/06

[52] U.S. Cl. ..... 34/235; 34/134; 34/606

[58] Field of Search ..... 34/235, 222, 227, 34/62, 104, 129, 140, 175, 176, 179, 181, 202, 108, 606, 609, 610, 134, 138; 285/201, 215; 277/178; 248/56, 75; 16/2, 3; 454/339, 271; 126/314, 317

[56] References Cited

U.S. PATENT DOCUMENTS 5,020,512 6/1991 Vago et al. ..... 126/314

5,199,190 4/1993 Mayer et al. ..... 34/235

*Primary Examiner*—Henry A. Bennett

*Assistant Examiner*—Steve Gravini

*Attorney, Agent, or Firm*—Vincent E. Young; Teresan W. Gilbert

[57] ABSTRACT

A quick connector assembly having a conical end section, a collar, and a cylindrical sleeve section attached to an external vent system for easy and quick connection of a dryer vent exhaust system employing rigid tubing and an external vent.

6 Claims, 2 Drawing Sheets

QUICK CONNECTOR FOR A DRYER DUCT AND EXTERNAL VENT

BACKGROUND OF THE INVENTION

1. Field of the Invention

The present invention relates to a vent exhaust system for clothes dryers. The present invention further relates to easy hook up of a dryer vent exhaust system which employs rigid tubing with an external vent through a quick connector assembly. It is understood throughout this specification that the dryer vent exhaust system employs rigid tubing or ducts unless stated to the contrary.

2. Description of the Prior Art

Installation of a clothes dryer exhaust system into an external vent is difficult due to the limited space available to perform the work. Generally, a dryer is fitted into a space just wide enough to receive it. Therefore, it is difficult to make the dryer vent exhaust system connection to the external vent once the dryer is positioned near the wall. Further, by making the dryer vent exhaust system connection into the external vent when the dryer is away from the wall may result in the dryer flexible vent tubing becoming crushed, flattened or kinked upon positioning the dryer close to the wall, resulting in poor airflow. Therefore, it is advantageous to employ rigid tubing for the dryer vent exhaust system. However, it is difficult to hook up rigid dryer vent tubing to the external vent system because the tubing and vent must be positioned exactly for a telescopic inner connection.

A dryer exhaust vent is disclosed in U.S. Pat. No. 4,967,490. This patent describes a dryer exhaust vent which locates reverse flow blocking veins internally of the vent, in the vent housing, to serve as a closure for the inlet opening.

A universal dryer duct and vent is disclosed in U.S. Pat. No. 5,145,217. This patent discloses a dryer duct assembly which employs two universal elbow components so as to secure the dryer duct ventilation to the external wall.

Neither of these patents address the problem of easy installation and a quick and easy connection of a dryer vent exhaust system employing rigid tubing into an external vent. It is advantageous to employ the quick connector assembly of the instant invention for easy installation and hook up of a dryer vent exhaust system with rigid tubing and an external vent system.

An object of the invention is to provide a quick connector assembly between a dryer vent exhaust system with rigid tubing and an external vent system. The quick connector assembly enables a workman to complete the dryer vent hook-up by simply guiding the dryer vent exhaust system rigid tubing/duct into the quick connector which is attached to the external vent.

Another object of the invention is to provide a quick connector assembly that results in easy installation of the dryer vent exhaust system and the external vent.

SUMMARY OF THE INVENTION

The present invention is a novel quick connector assembly for easy installation of a dryer vent exhaust system and an external vent system. The rigid tubing of a dryer vent exhaust system fits into the quick connector. The quick connector assembly is attached to the external vent system.

The quick connector assembly includes a hollow body having a collar, a conical section and a cylindrical sleeve section. The quick connector assembly allows for and promotes easy installation of the dryer vent exhaust system with the external vent system.

DESCRIPTION OF THE PREFERRED EMBODIMENT

Figure 1:
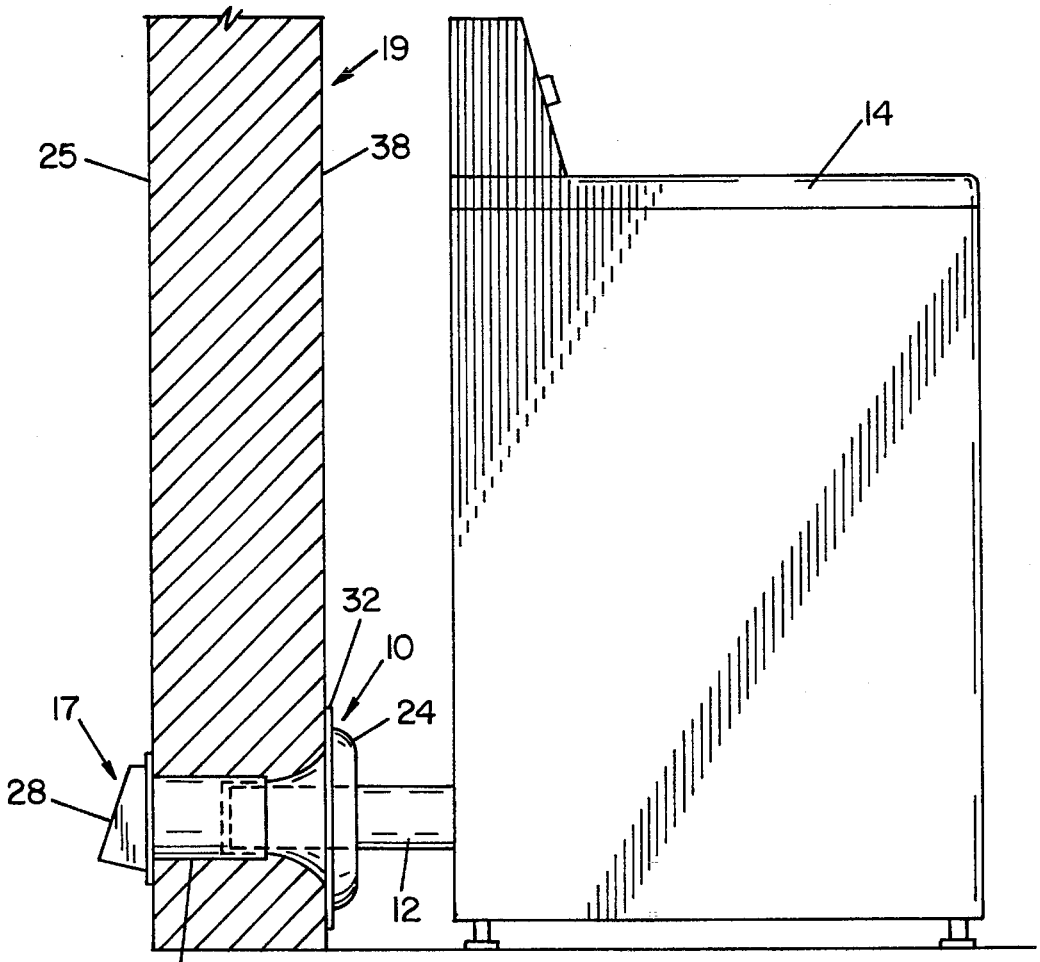
FIG. 1 is a side elevational view showing a typical horizontal installation of a dryer exhaust vent into the quick connector assembly attached to an external vent system.

Referring now to the drawings, specifically FIG. 1, which shows a quick connector assembly 10, for use with a dryer vent exhaust system 12 for a clothes dryer 14. FIG. 1 depicts a typical horizontal installation, however the present invention will operate with any installation plan and any dryer vent exhaust system employing rigid tubing including connectors and/or elbows. The function of the quick connector assembly 10 is to facilitate self-guiding of the dryer vent rigid tubing 12 into the quick connector assembly 10 which is connected to the external vent system 17, to carry moisture from the dryer 14 to the atmospheric air outside the exit wall 19. The dryer vent exhaust system 12 is interconnected to the external vent system 17 through the quick connector assembly 10 which quick connector assembly is affixed to the exit wall 19 and attached to the external vent system 17. A workman pushes the dryer 14 into place while guiding the dryer vent rigid tubing 12 into the quick connector assembly 10 which is in contact with the external vent system 17.

Figure 2:
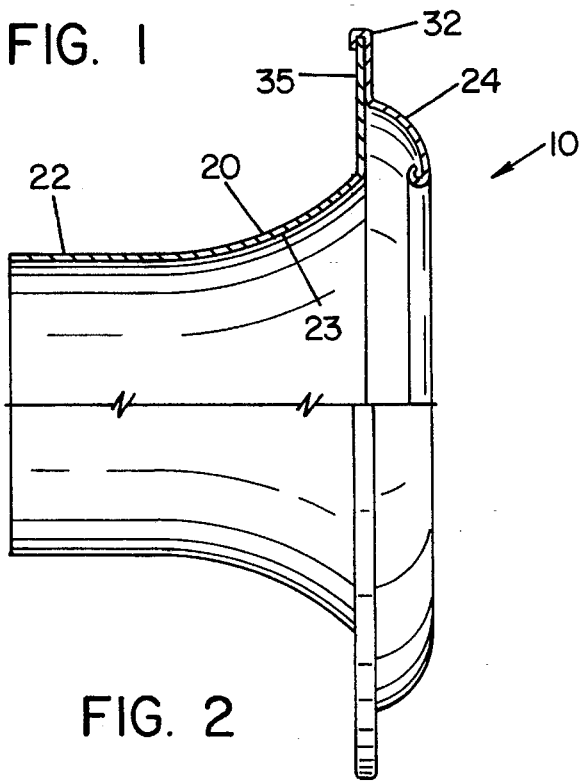
FIG. 2 is a side elevational view of the quick connector assembly.
Figure 3:
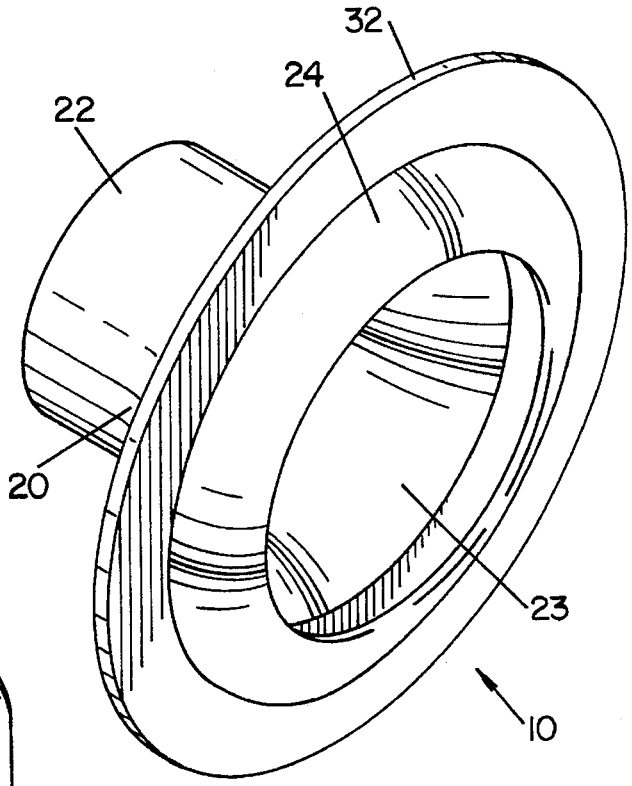
FIG. 3 is a perspective view of the quick connector assembly.

The quick connector assembly 10 consists of a conical section 20, a cylindrical sleeve section 22 and a collar 24, see FIGS. 2 and 3. The quick connector assembly 10 is hollow throughout and generally has an internal smooth surface 23 so that the dryer vent rigid tubing 12 does not snag or catch as it is being guided into the quick connector assembly 10 which is attached to the external vent system 17.

The cylindrical sleeve section 22 is fitted snugly through the hole in the exit wall 19. The external vent system 17 is attached to the hole on the outer side 25 of the exit wall. The cylindrical sleeve section 22 has a length generally long enough to fit snugly through the exit wall 19 and attach to the exhaust vent system 17. A duct 26 of the external vent system 17 snugly overlaps the cylindrical sleeve section 22. The cylindrical sleeve section 22 is secured to the external vent system 17 by contact friction. The external vent system 17 may be any of the conventional systems which generally includes a duct 26 and a vent cap assembly 28. The vent cap assembly 28 may be any of the conventional vents such as screened, flapped, hooded, louvered, weather shields or the like which allow free exit of dryer air and that are appropriate for the safety criteria, useful as a barricade against unwanted intrusions such as small rodents, and appropriate appearance for the particular building conditions.

The conical section 20 is between the cylindrical sleeve section 22 and the collar 24. The conical section 20 is tapered downward from the collar 24 to the cylindrical sleeve section 22. The conical section 20 has a smooth internal surface 23. Generally the conical section 20 has a diameter in the range of about 12" to about 5" preferably about 6" to about 8" where it connects to the collar 24 and tapers downward to a diameter wide enough, generally about 4", to allow the typical dryer vent 4" rigid tubing 12 to be guided inward and secured. The large end of the conical section 20 is tapered toward the conical sleeve section 22 to facilitate self-guiding of the rigid dryer vent tubing 16 into the cylindrical sleeve section 22 which is attached to the external vent system 17.

The collar 24 has generally a rounded dome appearance with a peripheral circular flange edge 32. An inner flat side 35 of the circular flange edge 32 is fitted against an inner side 38 of the exit wall 19. The circular flanged edge 32 also may be used for mounting the quick connector assembly 10 to the inner side 38 of the exit wall 36. The quick connector assembly 10 is mounted by any means for fastening such as friction, screws, nails, bolts and the like. Typically the circular flange edge 32 is about 2" to about ¼" , preferably about 1" to about 1½" wide. The circular flange edge 32 seals the quick connector assembly 10 to the inner side 38 of the exit wall 36 to prevent the influx of outside atmospheric air coming into the room.

The quick connector assembly 10 is typically constructed from metal such as aluminum, steel; plastic and the like. The quick connector assembly 10 is formed by conventional techniques.

Figure 4:
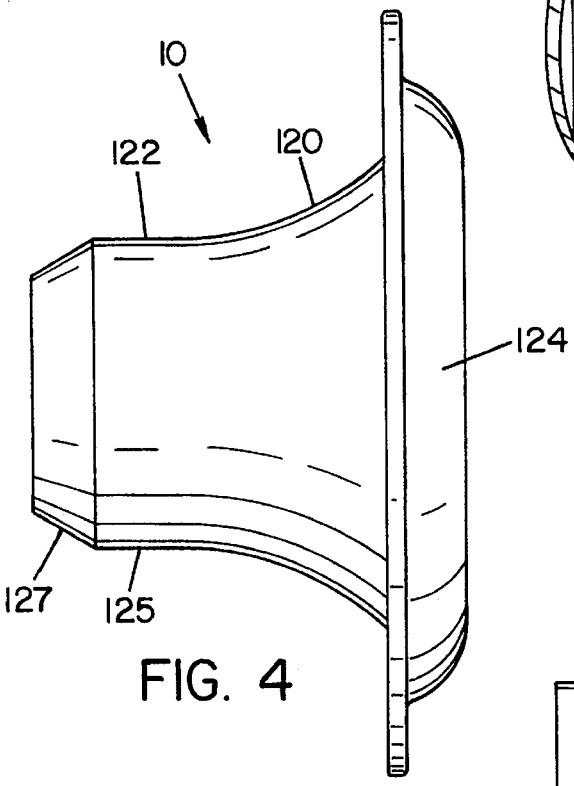
FIG. 4 is an alternative side elevational view of the quick connector assembly.

Another embodiment of the invention, shown in FIG. 4, shows a quick connector assembly 10 having a conical section 120, a cylindrical sleeve section 122 and a collar 124. The cylindrical sleeve section 122 has a cylindrical sleeve portion 125 and a tapered end 127. The tapered end 127 prevents the dryer vent rigid tubing 12 from moving into the external vent system 17.

Figure 5:
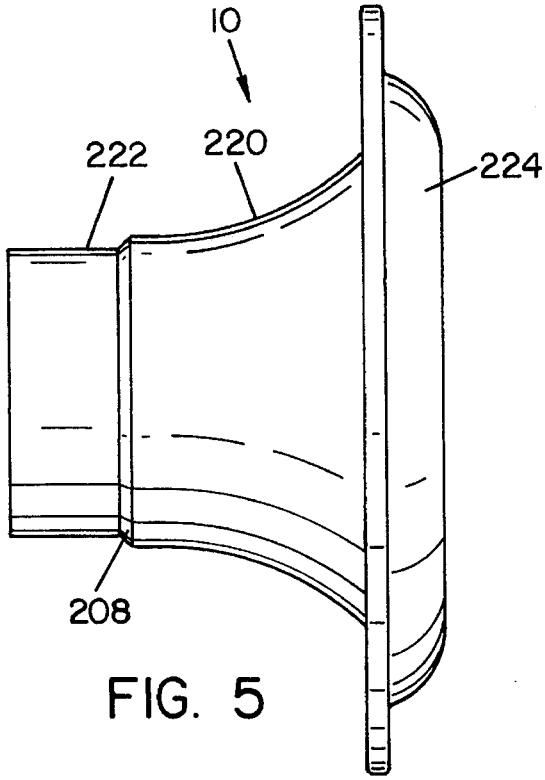
FIG. 5 is another alternative side elevational view of the quick connector assembly.

Another embodiment of the invention, shown in FIG. 5, shows a quick connector assembly 10 having a conical section 220, a cylindrical sleeve section 222 and a collar 224. The quick connector assembly 10 has a ridge 208 between the cylindrical sleeve section 222 and the collar 224. The ridge 208 prevents the dryer vent rigid tubing 12 from moving into the external vent system 17.

Another embodiment of the invention is to have the quick connector assembly 10 attached to the dryer vent rigid tubing 12 of the dryer vent exhaust system 10. The quick connector assembly 10 attached to the rigid dryer vent tubing 16 would be inserted into the duct 26 of the external vent 17 for easy hook up of the dryer vent exhaust system 10 to the external vent system 17.

The assembly and operation of the quick connector assembly is as follows: The quick connector assembly is inserted through the hole on the inner side of the exit wall. The external vent system is attached on the outside of the exit wall. The cylindrical sleeve section is fitted snugly through the hole of the exit wall and secured to the duct of the external vent system. The duct of the external vent system overlaps the cylindrical sleeve section. The flat side of the circular flanged edge on the quick connector assembly is flush and secured by any conventional means to the inner side of the exit wall.

The dryer vent tubing is guided through the conical section into the cylindrical sleeve section of the quick connector assembly secured to the exit wall by pushing the dryer into place. Further movement of the dryer vent tubing is stopped by friction or contact of the dryer tubing with the cylindrical sleeve section. In each of the alternative embodiments, respectively, movement of the dryer vent tubing is stopped in the quick connector assembly by the tapered end, see FIG. 4 or the ridge of the cylindrical sleeve section, see FIG. 5.

Manufacture of the quick connector assembly is straight forward and can be automated. The quick connector assembly can be installed easily and the dryer vent exhaust system can be interfitted easily into the external vent system through the quick connector assembly by a person of little skill.

In the above description of the invention, those skilled in the art will perceive improvements, changes and modifications. Such improvements, changes and modifications within the skill of the art are intended to be covered by the appended claims.

What is claimed is:

1. A quick connector assembly comprising a one-piece hollow body including a) a collar connected to a clothes dryer vent tubing and for conducting exhaust air and products away from a clothes dryer, b) a conical section between the collar and a cylindrical sleeve having the conical section tapered downward from the collar to the cylindrical sleeve to facilitate quick connection of the clothes dryer vent tubing to the conical section and to prevent movement of the clothes dryer vent tubing at the tapered section, c) the cylindrical sleeve section connected to an external vent system of the clothes dryer for conducting the exhaust air and products to an outside through an external wall, and d) exhaust products transmission means for conducting exhaust air and products directly from the clothes dryer vent exhaust system to the outside through the external wall.

2. The assembly of claim 1 wherein the collar has a circular flanged end and the cylindrical sleeve section has one end attached to the external vent system by contact friction and the other end is connected to the conical section.

3. The assembly of claim 1 including a ridge between the cylindrical sleeve section and the collar, wherein the ridge prevents the rigid tubing from moving into the external vent system.

4. The assembly of claim 1 wherein the cylindrical sleeve section includes a cylindrical sleeve portion and a tapered end, wherein the cylindrical sleeve portion is connected to the conical section and wherein the tapered end interfits into a duct of the external vent system and further prevents the rigid tubing from moving into the external vent system.

5. The assembly of claim 1 further comprising a smooth internal surface which is constructed from material selected from the group consisting of metal, aluminum, steel, and plastic.

6. A quick connector assembly comprising a one-piece hollow body including a) a collar connected to a clothes dryer vent tubing said collar including a circular flanged end having an inner side for attaching to an inner side of a wall, b) a conical section between the collar and a cylindrical sleeve having the conical section tapered downward from the collar to the cylindrical sleeve to facilitate quick connection of the clothes dryer vent tubing to the conical section and to prevent movement of the clothes dryer vent tubing at the taper, c) the cylindrical sleeve section having one end attached to the conical section and having the opposing end connected to an external vent system, and d) exhaust products transmission means for conducting exhaust air and products directly from the clothes dryer vent exhaust system to the outside through an external wall.

* * * * *

UNITED STATES PATENT AND TRADEMARK OFFICE

CERTIFICATE OF CORRECTION

PATENT NO. : 5,584,129

DATED : 12/17/96

INVENTOR(S) : Doyt J. Williamson

It is certified that error appears in the above-identified patent and that said Letters Patent is hereby corrected as shown below:

On the Title page, after item [76] Inventor, please add item --[73] Assignee: Nu-Tec Products, Inc.

Signed and Sealed this

Fourteenth Day of April, 1998

Bruce Lehman

*Attest:*

BRUCE LEHMAN

*Attesting Officer*

*Commissioner of Patents and Trademarks*